428-408 SR
3/20/84 XR 4,438,173

United States Patent [19]

Trost

[11] 4,438,173

[45] Mar. 20, 1984

[54] TRIAXIAL FABRIC

[75] Inventor: Wayne C. Trost, Rockford, Ill.

[73] Assignee: Barber-Colman Company, Rockford, Ill.

[21] Appl. No.: 515,786

[22] Filed: Jul. 21, 1983

[51] Int. Cl.[3] ..... B32G 7/08

[52] U.S. Cl. ..... 428/221; 139/383 R; 139/DIG. 1; 428/224; 428/257; 428/408; 428/225; 428/902

[58] Field of Search ..... 139/DIG. 1, 383 R; 428/221, 224, 257, 408, 902, 225

[56] References Cited

U.S. PATENT DOCUMENTS 28,155 9/1974 Dow ..... 139/383 R
4,191,219 3/1980 Kaye ..... 139/383 R

*Primary Examiner*—James J. Bell
*Attorney, Agent, or Firm*—Ratner & Prestia

[57] ABSTRACT

A plurality of triaxial weaves particularly suitable for reinforcement in composite materials, for conformability to curved surfaces, and for inclusion of high modulus fibers. Each includes relatively unstabilized yarn courses, and each is weavable on a known machine.

15 Claims, 5 Drawing Figures

TRIAXIAL FABRIC

BACKGROUND OF THE INVENTION

This invention pertains to triaxial fabric of specific constructions more readily conformable to a shaped surface and more readily weavable. More particularly, this invention pertains to triaxial fabric constructions particularly adapted to the incorporation of high modulus fibers therein.

Stable, pliable triaxial fabrics of various weave patterns and with various properties are disclosed and claimed in U.S. Re. Pat. No. 28,155—Dow (of common assignment herewith). Variants of such fabrics more suitable for use as substrates or reinforcement in molded products are disclosed and claimed in U.S. Pat. No. 3,874,422—Dow (also of common assignment herewith). The weaves of the -422 patent are adapted for use as substrate or reinforcement applications by virtue of their better conformability or drapability about curved and complex surfaces. This property arises primarily from the incorporation in the weaves of the -422 patent of yarn courses not fully secured within the weave against transverse movement by interlocking intersections with other yarn courses. The weaves of the -422 patent are also of uniform and controlled compliancy and porosity.

A difficulty encountered with weaves of the -422 patent, however, is that these weaves are not readily adapted to be formed or woven on practical triaxial fabric-forming machinery known to date. While there has been a need for such fabrics and weaves, conformable triaxial weaves, suitable for use as molded product reinforcement or substrate applications and readily weavable on known machines have heretofore been unknown.

A somewhat separate problem is the continuing and progressive need for ever stronger and ever lighter composite molded materials including high strength reinforcements. High modulus fibers, such as graphite fiber, are an ideal material for such reinforcement. There is, therefore, a very significant need for practical woven constructions or weaves of substrate materials, adapted to include high strength, high modulus fibers such as graphite fiber, which weaves or constructions are also particularly adapted to conform to curved or complex surfaces for forming complex molded products. Most importantly, there is a need for such weaves which are more practical than those heretofore available by virtue of the fact that they may be formed on a known type of triaxial fabric-forming machinery.

It is the general object of the present invention to provide fabrics and weave constructions which may satisfy all of the foregoing needs.

BRIEF DESCRIPTION OF THE INVENTION

This general object, and other more specific objects which will become apparent in the course of the subsequent description of this invention, are met by a pliable triaxial fabric comprising three sets of interwoven angularly intersecting parallel yarn courses, at least one of which includes unstabilized yarn courses, that is yarn courses substantially free of interwoven relationships with intersecting yarn courses. The remaining yarn courses are substantially interwoven with intersecting yarn courses and the fabric is weavable on a conventional, bi-plain triaxial fabric-forming machine.

Four specific weave constructions are disclosed in detail. The first of these is a modification of the "basic triaxial weave," i.e., that illustrated in FIG. 1 of U.S. Re. Pat. No. 28,155. The "basic" weave is modified, however, by the incorporation of a set of yarn courses parallel to the filling yarn in the basic weave. These additional yarn courses, referred to as stuffer yarns, are interposed between the regular filling yarns and are not interwoven with intersecting, angularly disposed warp yarns i.e., one set of warp yarns always remains over the stuffer yarn, and the other set of warp yarns always remains under the stuffer yarns.

The second weave specifically disclosed herein is similar to a conventional triaxial weave referred to as a bi-plain weave, modified by the omission of two-thirds of the normal filling yarn courses in that weave. The remaining filling yarns then are essentially unstable and interwoven only loosely with intersecting warp yarns.

In the third weave construction disclosed herein, each filling yarn remains always over or under one of the sets of parallel intersecting angularly disposed warp yarns but is interwoven with the remaining set of intersecting angularly disposed warp yarns. Successive filling yarns are each interwoven with either the same angularly disposed warp yarns with which the succeeding filling yarn was interwoven but in an opposite pattern thereto or with the angularly disposed intersecting warp yarns other than those with which the preceding warp yarn was interwoven.

The fourth weave disclosed herein is a modification of the third, wherein every sixth pick or filling yarn is interwoven alternately with the intersecting, angularly disposed warp yarns of both intersecting warp yarn sets.

For a better understanding of this invention, reference may be made to the detailed description thereof which follows, taken in conjunction with the accompanying figures and the subjoined claims.

DETAILED DESCRIPTION OF THE INVENTION

Figure 1:
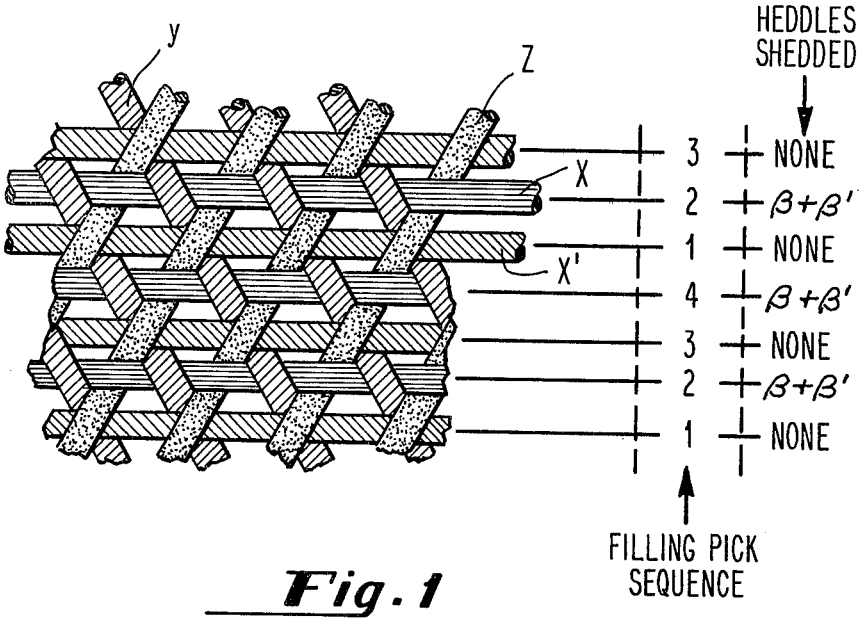
FIG. 1 is a plan view of the first triaxial fabric construction disclosed herein, referred to sometimes as the "filled" or "stuffed" basic triaxial weave.

Referring specifically to FIG. 1, there is shown a filled or stuffed basic triaxial weave, comprising a first set of parallel, angularly disposed warp yarns Y in the 11 o'clock direction; a second parallel, angularly disposed set of warp yarns Z in the 1 o'clock direction; and two sets of filling yarns X and X', all parallel to one another, in the 3 o'clock direction. As in the conventional basic weave, all of the yarns of one warp set Z pass over all yarns of the other warp set Y, while the conventional filling yarn X alternately passes over all Z yarns and under all Y yarns.

In the stuffed or filled basic weave shown in FIG. 1, the yarn courses of a second set of filling or stuffer yarns X' are each interposed between adjacent filling yarn courses X. The yarn courses of the stuffer yarn course X' are not interwoven with any intersecting yarns.

Figure 5:
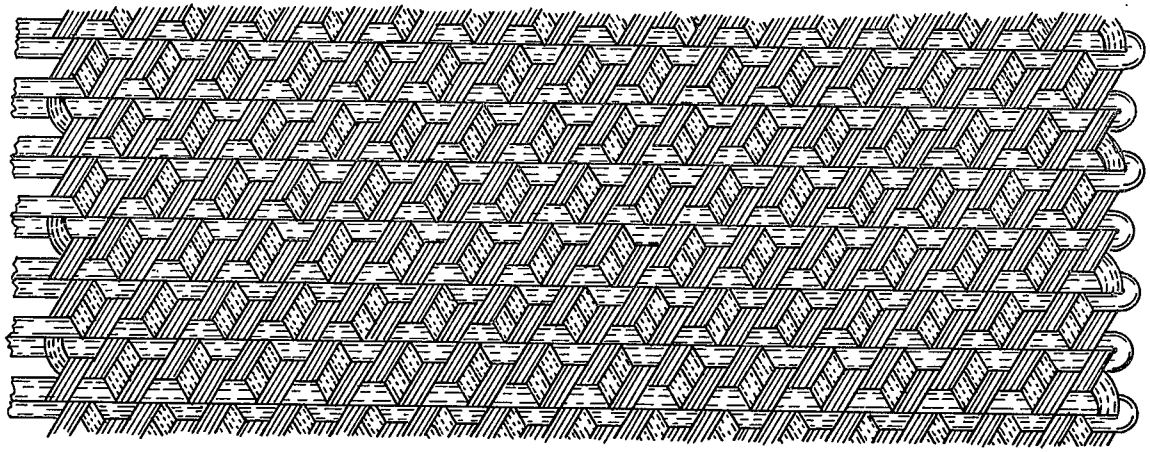
" and FIG. 5 is a plan view of a known triaxial fabric weave, sometimes referred to as the "bi-plain weave."

The fabric of FIG. 1 may be formed on a conventional, triaxial fabric-forming machine of the type disclosed in U.S. Pat. No. 4,036,262—Darsie et al, modified to form what is known as the bi-plain weave (as illustrated in FIG. 5), by the incorporation of a second set of heddles above the first set, the heddles of which are transversely disposed in the spaces between the heddles of the first set. The fabric of FIG. 1 is woven by a weaving sequence in which the second set of heddles are not used, and the first set of heddles $\beta$ and $\beta'$ (referring to the heddles oppositely disposed across the weaving space) are shedded in accordance with the filling pick sequence shown to the right of the fabric as illustrated in FIG. 1. In other words, both of the alternately disposed heddles are shedded for the insertion of filling or pick yarns X, and no heddles are shedded for the insertion of stuffer yarn X'.

The fabric construction of FIG. 1 is particularly adapted to the use of a soft, low twist yarn as the stuffer yarn. Such a yarn is flattened and thus expands transversely to the center line of the yarn in the plane of the fabric so as substantially to occupy the space between the regular filling yarns of the basic weave and thus to reduce the porosity thereof.

The fabric of FIG. 1 is also adapted to the inclusion of typical high strength, high modulus yarns, such as graphite yarns, as the stuffer yarns inasmuch as the stuffer yarns are not interwoven with remaining yarn courses and thus follow a relatively non-torturous path through the fabric. This avoids the strength degradation which often accompanies the incorporation of a high modulus yarn in a torturous configuration within a woven fabric.

Another possible variant of the construction shown in FIG. 1 is the utilization of high modulus fibers for the warp yarns and for the stuffer yarns X', combined with lower modulus fiber as the filling yarn course X. The relatively lower modulus fiber is better adapted to the torturous path forced on the filling yarn, particularly as it is interwoven with the higher modulus warp yarns, and thus serves to better preserve the integrity of the fabric while permitting the strength development of the fabric in the remaining yarn courses. Thus, in one application of this invention, a 12 K, i.e., a 12,000 mono-filament bundle, graphite yarn is used for the stuffer and warp yarns, while a 195 denier Kevlar (an aramid yarn, commercially available from the duPont Company) is used as the filling yarn.

Still another possible variant of the weave shown in FIG. 1 utilizes 12 K graphite yarns for each of the warp yarn courses and 6 K graphite yarns for the filling and stuffer yarn courses, so as to provide essentially isotropic strength characteristics to the fabric, with reduced porosity as compared to the basic weave.

Figure 2:
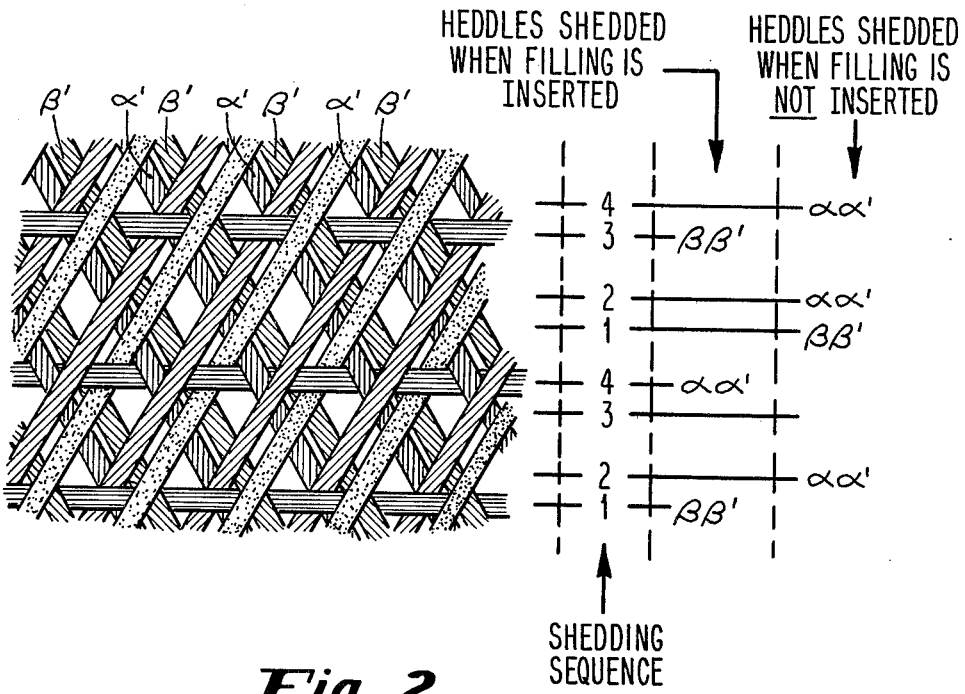
FIG. 2 is a plan view of the second triaxial fabric disclosed herein, sometimes referred to as the "one-third pick bi-plain weave;"

Referring now to FIG. 2, there is shown the one-third pick bi-plain weave, woven on a conventional bi-plain fabric-forming machine, with the first set of heddles $\alpha$ and $\alpha'$ and the second set of heddles $\beta$ and $\beta'$ shedded as shown in the shedding sequence diagrammatically illustrated to the right of the fabric shown in FIG. 2. Picks or filling yarns are inserted only in every third fill insertion stage. This is accomplished on a bi-plain machine by merely blocking the filling thread from being picked up by the entry rapier for those filling sequences where a filling yarn is not desired. As diagrammatically illustrated, on filling pick 1, the $\beta$ and $\beta'$ heddles are shedded and a fitting pick is inserted. On pick 2, $\alpha$ and $\alpha'$ heddles are shedded, but no filling pick is inserted. When the $\alpha$ and $\alpha'$ heddles are unshedded, there is no filling caught between them. On pick 3, the $\beta$ and $\beta'$ heddles shed again, but no filling pick is inserted. Again, as these $\beta$ and $\beta'$ heddles unshed, there is no filling pick caught between them. On pick 4, the $\alpha$ and $\alpha'$ heddles shed again, and this time a filling pick is inserted.

On the following picks, 1 and 2, no filling thread is inserted, but one is again inserted on the next pick 3. On the third set of four picks, the filling is inserted only on pick 2. The pattern repeats after three sets of four picks, so pick 1 of the fourth set of four is the same as pick 1 of the first set of four, and the pattern then repeats indefinitely. As is apparent from FIG. 2, the yarn courses in the one-third pick bi-plain are relatively unstabilized, i.e., substantially non-interlocked or interwoven with the intersecting yarn courses so as to lend compliancy and conformability to the fabric, by which the fabric is better adapted for use as a substrate or reinforcement weave in the formation of composite materials. The fabric, of course, is also anisotropic.

The fabric of FIG. 2, in addition to conforming more readily to curved surfaces, also is relatively open, which is a desirable attribute in some molding applications. Moreover, because of the openness of the weave, the fabric is also adapted to be formed with the angularly disposed warp yarns at angles of from $\pm 72°$ up to $\pm 45°$ from the filling yarn. This may be a desirable characteristic in some applications. The fabric illustrated includes warp yarn disposed at an angle of $\pm 60°$.

Figure 4:
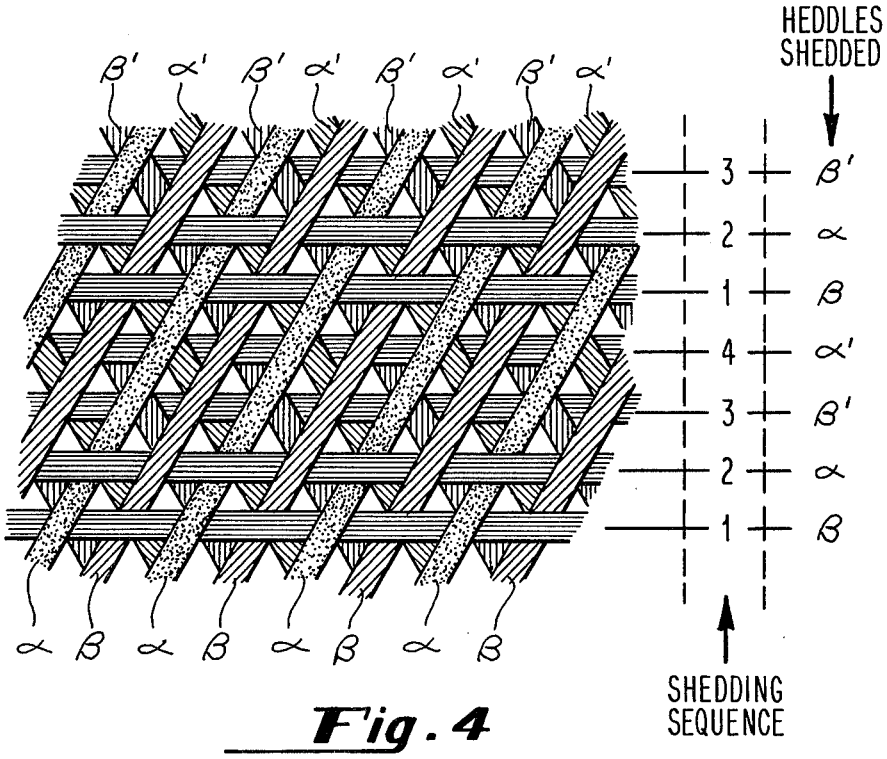
FIG. 4 is a plan view of the third fabric construction disclosed herein, sometimes referred to as a "tri-satin weave.

Referring now to FIG. 4, there is illustrated the tri-satin weave and the shedding sequence utilized in the formation of this weave on a known machine of the type used to form the bi-plain weave. Particularly, it will be noted that with the insertion of each pick or filling yarn, heddles from only one side of the warp yarn weaving arrays are shedded (all heddles referred to with a prime notation are located on one side of the warp yarn weaving array, and all heddles designated without a prime are located on the other side of the array). It will be noted that filling picks 1 and 2 only interweave with $\alpha$ and $\beta$ 1 o'clock yarns, while filling picks 3 and 4 only interweave with $\alpha'$ and $\beta'$ 11 o'clock yarns. Thus, each filling yarn interweaves only with either 11 o'clock yarns or 1 o'clock yarns, but not both. For this reason, the fabric is essentially tubular, i.e., it comprises essentially two planar arrays of loosely interwoven yarn courses, the arrays connected only by the continuity of the warp yarn courses as they reverse direction at the edges of the arrays.

Obviously, this fabric is unstable, because of the absence of locked intersections of intersecting yarn courses but highly compliant and conformable to curved surfaces. It is substantially isotropic, however, and of uniform porosity. Accordingly, the weave of FIG. 4 is considered a possible candidate for a substrate or reinforcement weave utilizing graphite yarns and epoxy prepreg materials.

Figure 3:
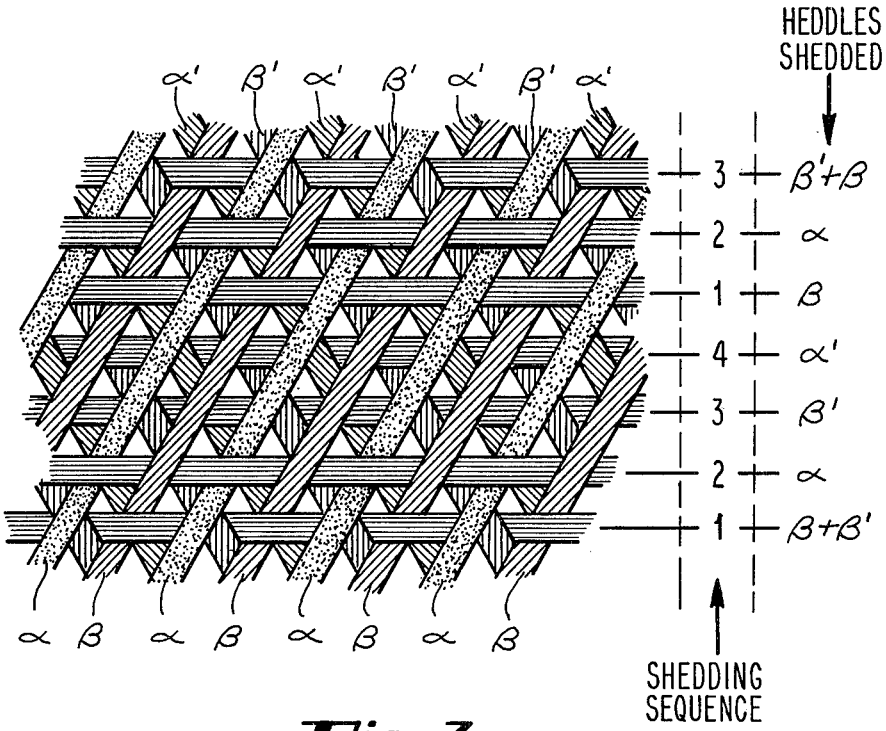
FIG. 3 is a plan view of the fourth fabric construction disclosed herein, sometimes referred to as a "bi-plain three float weave;"

Referring now to FIG. 3, there is shown a fabric which is a modification of that shown in FIG. 4, wherein heddles from opposite sides of the weaving array are shedded for every sixth filling yarn course or pick. This is diagrammatically illustrated in the shedding sequence listed to the right of the fabric shown in FIG. 3. In this manner, the warp yarns from the two arrays, that is the 11 o'clock and 1 o'clock arrays, are both interwoven with every sixth filling yarn course so that the fabric is not tubular.

Like the fabric of FIG. 4, that shown in FIG. 3 is highly drapable and compliant, isotropic, and relatively uniform in porosity.

FIG. 5 is a plan view of a bi-plain weave, a weave known prior to the present invention. It is included here only for comparison because the weaves heretofore described may be considered derivatives of the bi-plain weave. The weaving sequences for the weaves of this invention have been developed for use on a weaving machine originally designed for producing the bi-plain weave. The weaves of the present invention all differ from the bi-plain weave, however, in that each includes, to a significant degree, yarn courses which are not stabilized or secured from transverse movement. These yarn courses include relatively little interweaving with intersecting yarn courses.

In this manner, the weaves of the present invention are all adapted to incorporate in at least one yarn course modern, high strength, high modulus fibers, such as graphite fibers, without the accompanying strength degradation produced when such yarns are inserted in tightly interwoven configurations and must follow a torturous path through the woven fabric construction.

Moreover, the fabrics of this invention differ from that shown in FIG. 5 by virtue of their much higher degree of compliancy and conformability to curved surfaces, by which they are better adapted to be utilized as substrate or reinforcement fabrics in composite molded products.

While this invention has been described with reference to specific embodiments thereof, it is not limited thereto. Accordingly, the appended claims are intended to be construed to encompass not only those forms of the invention described and illustrated, but to such other forms, embodiments, and variants of the invention as may be devised by those skilled in the art without departing from the true spirit and scope of the invention.

What is claimed is:

1. A pliable, triaxial fabric comprising at least three sets of interwoven, angularly intersecting parallel yarn courses, at least one of said sets including at least one unstabilized yarn course substantially free of interwoven relationships with intersecting yarn courses, the remaining yarn courses being substantially interwoven with intersecting yarn courses, said fabric being weavable on a conventional, bi-plain triaxial fabric-forming machine.

2. A pliable, triaxial fabric, as recited in claim 1, comprising four sets of parallel yarn courses;

the first three of said sets comprising a "basic triaxial weave," two of said first three sets comprising warp yarn sets of said basic weave, said warp yarn sets being angularly disposed with respect to one another, the third of said first three sets comprising the basic weave fill yarn set, the warp yarn sets being symmetrically disposed with respect to said fill yarn set;

the fourth set of parallel yarn courses comprising yarn courses parallel to and interposed between yarn courses of said basic weave fill yarn set, said yarn courses of said fourth yarn course set always lying over the yarn courses of one of said warp yarn sets and under the yarn courses of the other of said warp yarn sets.

3. A fabric, as recited in claim 2, wherein all of said yarn courses are comprised of a high modulus fiber.

4. A fabric, as recited in claim 3, wherein said fiber is a carbon fiber.

5. A fabric, as recited in claim 2, wherein said basic weave fill yarn course set is comprised of a low modulus fiber and all of said other yarn courses are comprised of a high modulus fiber.

6. A fabric, as recited in claim 5, wherein said fourth yarn course set is comprised of a soft, low twist yarn.

7. A pliable, triaxial fabric, as recited in claim 1, having three sets of parallel yarn courses, a fill set, and two warp sets, the respective yarn courses of which form symmetric angles with the yarn courses of said fill set, the yarn courses of both of said warp sets each comprising a pair of individual yarn strands, the yarn strands of each pair being slightly spaced from one another the yarn courses of said warp sets being separated from one another by a distance greater than the spacing between the paired yarn strands, the yarn courses of one of said warp yarn course sets always passing over the yarn courses of the other of said yarn course sets, said fill set comprising a plurality of single strand yarn courses, one of said fill yarn courses intersecting said warp yarn courses at each intersection of the two angularly disposed warp yarn courses and alternately passing over and under successive intersections of individual yarn strands from each of the two warp yarn course sets.

8. A fabric, as recited in claim 7, wherein said warp yarn courses are spaced about three yarn strand diameters from each adjacent warp yarn course.

9. A fabric, as recited in claim 7, wherein said warp yarn courses are comprised of a high modulus fiber.

10. A fabric, as recited in claim 7, wherein said fill yarn is of substantially larger diameter than said warp yarns.

11. A fabric, as recited in claim 7, wherein said warp yarn courses form angles of from $\pm 72°$ up to $\pm 45°$ with said fill yarn courses.

12. A fabric, as recited in claim 7, wherein said warp yarn courses form angles of $\pm 45°$ with said fill yarn courses.

13. A fabric, as recited in claim 7, wherein said warp yarn courses form angles of $\pm 60°$ with said fill yarn courses.

14. A fabric, as recited in claim 1, having three sets of parallel yarn courses, a fill yarn course set, and two angularly intersecting warp yarn course sets, each forming symmetric angles with said fill yarn course set, all of the yarn courses of one of said warp yarn course sets (FIG. 4, $\alpha$ and $\beta$) passing over all of the yarn courses of the other of said warp yarn course sets, (FIG. 4, $\alpha'$ and $\beta'$), said fill yarn course set including a four course sequence as follows:

course 1 passes over all of the yarn courses of said other of said warp yarn sets ($\alpha'$ and $\beta'$) and alternately over and under successive yarn courses of the one of said warp yarn course sets ($\alpha$ and $\beta$);

course 2 passes over all of the yarn courses of said other of said warp yarn sets ($\alpha'$ and $\beta'$) and under the warp yarn courses of said one set ($\alpha$ and $\beta$) which said course 1 fill yarn passed over and under the warp yarn courses of said one set which said course 1 fill yarn passed under;

course 3 passes under all of the yarn courses of said one of said warp yarn course sets ($\alpha$ and $\beta$), and alternately over and under successive yarn courses of said other warp yarn set ($\alpha'$ and $\beta'$); and course 4 passes under all of the yarn courses of said one of said warp yarn course sets ($\alpha$ and $\beta$) and passes alternately under the yarn courses of said other warp yarn set ($\alpha'$ and $\beta'$) which course 3 passed over and over the yarn courses of said other set which course 3 passed under.

15. A fabric, as recited in claim 14, wherein every sixth fill yarn passes alternatively over and under intersecting warp yarn pairs from the two warp yarn sets.

* * * * *